US006305954B1

(12) United States Patent
Aluise, Sr.

(10) Patent No.: US 6,305,954 B1
(45) Date of Patent: Oct. 23, 2001

(54) SPARKPLUG BOOT AND WIRE PROTECTOR AND ASSEMBLY

(75) Inventor: Joseph R. Aluise, Sr., Beltsville, MD (US)

(73) Assignee: Metro Motorsports, Inc., Beltsville, MD (US)

( * ) Notice: Subject to any disclaimer, the term of this patent is extended or adjusted under 35 U.S.C. 154(b) by 0 days.

(21) Appl. No.: 09/548,833

(22) Filed: Apr. 13, 2000

(51) Int. Cl.[7] ..... H01R 13/44
(52) U.S. Cl. ..... 439/125; 439/128
(58) Field of Search ..... 439/125, 128, 439/893

(56) References Cited

U.S. PATENT DOCUMENTS

| | | | | |
|---|---|---|---|---|
| 2,136,052 | | 11/1938 | Hurley . | |
| 2,564,764 | | 8/1951 | Kovac . | |
| 2,666,423 | * | 1/1954 | Johnson | 439/127 |
| 3,128,139 | * | 4/1964 | Estes | 439/126 |
| 3,697,796 | | 10/1972 | Livingston . | |
| 3,775,672 | | 11/1973 | Letosky . | |
| 4,145,106 | | 3/1979 | Livingston . | |
| 4,497,532 | | 2/1985 | Bezusko et al. . | |
| 4,671,586 | | 6/1987 | Debolt . | |
| 4,715,337 | | 12/1987 | Bohl et al. . | |
| 4,810,198 | | 3/1989 | Sturdevan . | |
| 4,947,809 | | 8/1990 | Hocking . | |
| 5,017,874 | | 5/1991 | Di Nunzio et al. . | |
| 5,163,838 | | 11/1992 | Tura, Jr. et al. . | |
| 5,332,394 | * | 7/1994 | Frost | 439/125 |
| 5,348,486 | | 9/1994 | Tura, Jr. et al. . | |
| 5,523,691 | | 6/1996 | Frus . | |
| 5,606,118 | | 2/1997 | Muth et al. . | |
| 5,649,830 | * | 7/1997 | Ellsom et al. | 439/128 |
| 5,813,872 | | 9/1998 | Evans et al. . | |

* cited by examiner

*Primary Examiner*—Brian Sircus
*Assistant Examiner*—Brian S. Webb
(74) *Attorney, Agent, or Firm*—Arent Fox Kintner Plotkin & Kahn, PLLC

(57) ABSTRACT

A substantially cylindrical ceramic protector that thermally insulates a silicone sparkplug boot surrounding a silicone covered sparkplug ignition wire connected to a sparkplug. An air gap between the protector and boot provides additional thermal insulation and evacuates leaked combustion gases to the atmosphere.

18 Claims, 1 Drawing Sheet

SPARKPLUG BOOT AND WIRE PROTECTOR AND ASSEMBLY

BACKGROUND OF THE INVENTION

1. Field of the Invention

This invention relates to a sparkplug boot and wire protector and assembly. More particularly, the invention relates to a protector that shields a silicone covered sparkplug wire and silicone sparkplug boot from extremely high temperatures derived from spark ignited engines.

2. Discussion of Related Art

Sparkplugs in conventional spark ignited engines are positioned in close proximity to exhaust manifolds. The exhaust manifolds are routed near a secondary ignition system and have been measured at temperatures exceeding approximately 1,240 degrees Fahrenheit for extended periods of time. The ignition system includes ignition wires, a metal clip, boot and a sparkplug.

The boot is typically constructed of silicone while the ignition wire is a conventional conductive wire covered with a silicone wrap (hereinafter referred to as a silicone wire). The silicone boot that attaches the sparkplug high voltage wire to the sparkplug begins offgasing at approximately 350 degrees Fahrenheit, at which time the silicone begins to break down and deteriorate.

To overcome this situation, conventional manufacturers place a shield, typically made of aluminum, over the silicone boot to protect the boot from the high temperatures. However, the shield is not long enough nor does it have enough insulating properties to protect the wire as well as the boot.

Furthermore, if the engine develops an exhaust leak at the exhaust manifold to the cylinder head gasket, hot exhaust gases leak directly onto the sparkplug boot shield, boot, the sparkplug itself and sparkplug wire. Since the sparkplug boot and wire are made of silicone, they begin to deteriorate. As the silicone boot and wire deteriorate, they become brittle and lose their dielectric value, causing a leakage of electricity and/or creates an open circuit.

Because the voltage is very high, ranging between a thousand volts to tens of thousands of volts, a high voltage spark can leak from the insulated area to ground without creating the spark in the gap of the sparkplug necessary to initiate the combustion process. Accordingly, the engine misfires and additional heat is created, thereby worsening the situation. If the embrittled sparkplug wire results in the open circuit condition, cross fire will occur, resulting in potentially catastrophic engine damage.

SUMMARY OF THE INVENTION

An object of this invention is to overcome the drawbacks of the conventional shield discussed above.

Another object of this invention is to provide a ceramic sparkplug boot protector that also extends over the sparkplug wire. The protector insulates the silicone boot and wire from the high temperatures the silicone cannot withstand. Specifically, the protector is designed to withstand temperatures up to approximately 5,000 degrees Fahrenheit. Furthermore, at an internal combustion engine temperature of 1,500 degree Fahrenheit in the region the protector is located, the protector will transfer less than 250 degrees Fahrenheit, well short of the silicone degradation point.

The ceramic protector is designed to extend out over the silicone sparkplug boot from the cylinder head recess beyond the exhaust manifold to protect the silicone sparkplug wire as well. The loose fit of the protector over the boot results in an air gap between the protector and boot. The air gap provides, in addition to the temperature insulation properties of the ceramic protector, further protection of the boot and wire from surface heat damage during extreme operating conditions.

BRIEF DESCRIPTION OF THE DRAWINGS

Other objects and features of this invention will be better understood from the following description, with reference to the accompanying drawings, wherein.

DETAILED DESCRIPTION OF PREFERRED EMBODIMENT

Figure 1A:
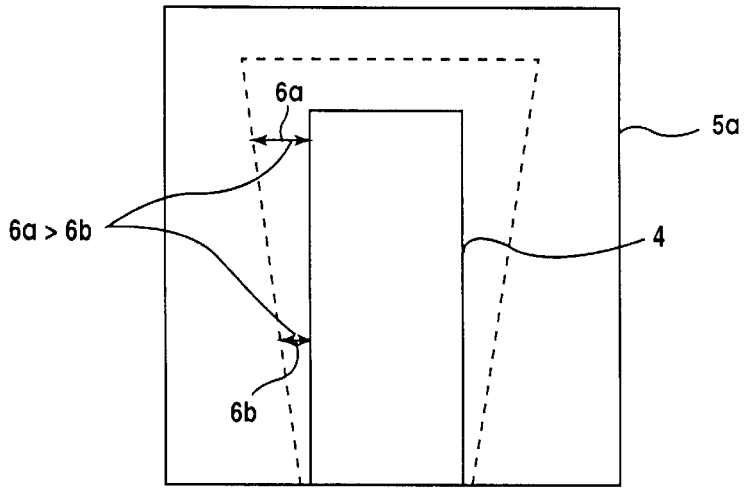
FIG. 1*a* is a schematic diagram illustrating an uneven air gap between the ceramic protector and silicon boot.

Referring to FIG. 1*a,* a silicone sparkplug wire 1 is connected to a conventional sparkplug 2 by a crimped metal clip 3. The sparkplug wire 1, sparkplug 2, and clip 3 are surrounded by a boot 4. The boot 4 is composed substantially of silicone and provides dielectric insulation, as well as mechanical strength, to the connection.

A protector 5 encompasses the wire 1, sparkplug 2, clip 3 and boot 4. The protector 5 is made of ceramic and provides thermal insulation to the silicone wire 1 and boot 4 from the heat generated by the engine (not shown). The protector 5 comprises a cylindrical first portion 5*a* connected to a cylindrical second portion 5*b* by a transition portion 5*c*. Ceramic paper 5*cp*, preferably a rollboard material, lines an interior surface of the protector 5.

Figure 2:
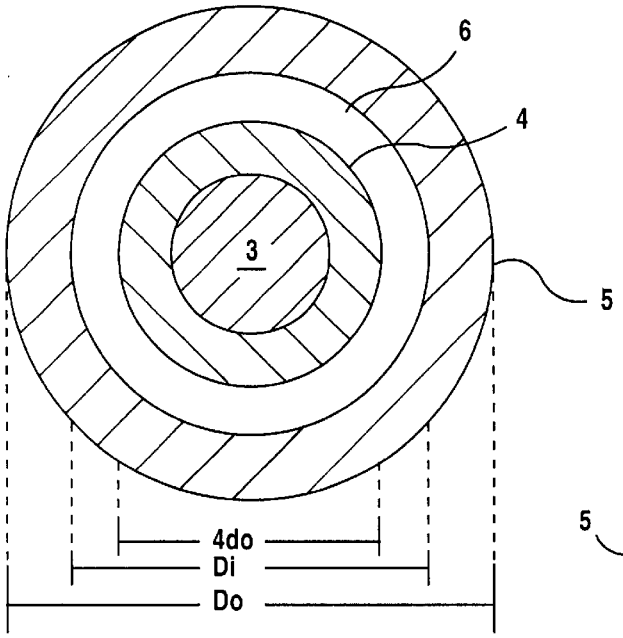
FIG. 2 is a sectional view taken along section line 2—2 of the protector and assembly illustrated in FIG. 1.

Referring to FIG. 2, the first portion 5*a* has constant inner and outer diameters Di and Do throughout a length L. The first portion 5*a* substantially surrounds the silicone boot 4 and at least the portion of the wire 1 connected to the sparkplug 2 by the clip 3. Furthermore, the inner diameter Di of the first portion 5*a* is larger than an outer diameter 4do of the boot 4 such that an air gap 6 is formed radially therebetween as well as axially at a location remote from the sparkplug 2 (FIG. 1*a*). The air gap 6 between the silicone boot 4 and first portion 5*a* of the ceramic protector 5 provides additional thermal insulation from the engine heat absorbed by the protector 5.

It should be noted that although FIG. 1*a* illustrates the air gap 6 as constant, it is within the scope of this invention to vary the thickness of the air gap 6. See FIG. 1*a*. For example, the air gap 6 could taper such that the thickness at a location remote from the sparkplug 2 is smaller than the thickness at a location proximate to the sparkplug 2. Also, the thickness of the air gap 6 could vary along the entire length of the silicone boot 4 so as to be wavy or undulate.

Figure 3:
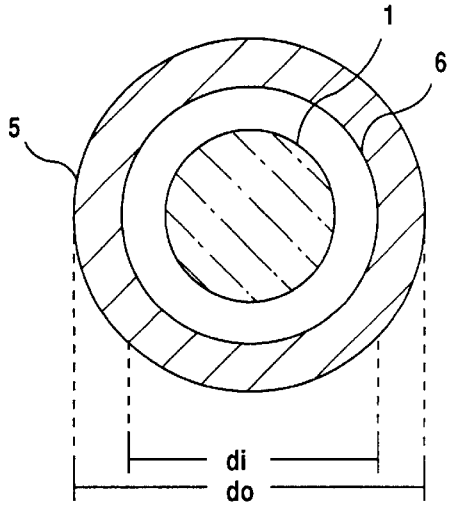
FIG. 3 is a sectional view taken along section line 3—3 of the protector and assembly illustrated in FIG. 1*a*.

Referring to FIG. 3, the second portion 5*b* of the protector 5 has an outer diameter do smaller than the inner diameter Di of the first portion 5*a*. Furthermore, an inner diameter di of the second portion 5*b* is sized to slidingly receive the wire 1. The second portion 5*b* is connected to the first portion 5*a* by the transition portion 5*c*, which has a continuously decreasing outer diameter in a direction from the first portion 5*c* to the second portion 5*b*. However, the transition portion 5*c*, like the second portion 5*b*, has a constant inner diameter to slidingly receive the wire 1.

Preferably, the ceramic protector 5 has a length of approximately 5.00 inches to provide thermal protection to the silicone boot 4 and wire 1, with a thickness of approximately 0.18 inches at the first and second portions 5*a* and 5*b*. The first portion 5*a* may have an outer diameter Do of 1.17 inches and an inner diameter Di of 0.81 inches. Also, the second portion 5*b* may have an outer diameter do of 0.768 inches and an inner diameter di of 0.409 inches. Furthermore, the ceramic paper 5*cp* lining the interior surface of the protector may have a thickness of approximately 0.0625 inches.

Additionally, the ceramic protector 5 could be manufactured from a steatite ceramic that is fired and glazed for strength, thermal insulation, and resist absorbing grease and/or oils. The steatite ceramic should also be able to withstand loads due to vibrations and thermal shocks.

The procedure for putting together the protector assembly will be discussed below.

Initially, the silicone wire 1 is slidingly passed through the second portion 5*b* of the ceramic protector 5 pulled out through the first portion 5*a*. Then, the wire 1 is slidingly passed through the silicone boot 4. Next, the crimped metal clip 3 is attached to an end of the wire 1.

Then, the metal clip 3 is attached to the sparkplug 2 to connect the wire 1 to the sparkplug. Next, the boot 4 is slid along the wire 1 until the wire 1, crimp 3 and sparkplug 2 are covered by the boot 4. Then, the protector 5 is slid along the wire 1 until the wire 1, crimp 3, sparkplug 2 and boot 4 are encompassed by the protector 5 and the air gap 6 is formed between the protector 5 and boot 4. The air gap 6 is located radially relative to the boot 4 as well as axially remote from the sparkplug 2.

As such, the ceramic protector 5 extends over the silicone wire 1 and boot 4 to thermally insulate the parts and prevent them from deteriorating. The protector 5 can withstand temperatures of approximately 5,000 degrees Fahrenheit and transfers approximately 250 degrees Fahrenheit to the boot 4 at a temperature of about 1,250 degrees Fahrenheit, well within the silicone degradation temperature of about 350 degrees Fahrenheit.

In addition, many modifications may be made to adopt particular situation or material to the teachings of the invention without departing from the scope thereof. Therefore, it is contended that this invention not be limited to the particular embodiment disclosed herein. But includes all embodiments within the spirit and scope of the disclosure.

What is claimed is:

1. A protector that thermally insulates a silicone sparkplug boot surrounding a silicone sparkplug ignition wire connected to a sparkplug, the protector comprises:

a cylindrical first portion having constant inner and outer diameters throughout a length of the first portion, wherein the first portion substantially surrounds the sparkplug boot and at least a portion of the sparkplug ignition wire connected to the sparkplug, the inner diameter of the first portion being larger than an outer diameter of the sparkplug boot, wherein an air gap is formed radially therebetween completely along an entire length of the sparkplug boot and axially at a location remote from the sparkplug to provide additional thermal insulation to the sparkplug boot and ignition wire.

2. The protector according to claim 1, wherein a thickness of the air gap between the protector and sparkplug wire is constant.

3. The protector according to claim 1, wherein a thickness of the air gap between the protector and sparkplug boot is not constant.

4. The protector according to claim 1, further comprising:

a cylindrical second portion having constant inner and outer diameters throughout a length of the second portion, wherein the inner and outer diameters of the second portion are smaller than the inner and outer diameters of the first portion; and a transition portion connecting the first and second portions, wherein the transition portion has a constant inner diameter and a continuously decreasing outer diameter in a direction from the first portion to the second portion.

5. The protector according to claim 4, wherein the first, second and transition portions are integrally formed.

6. The protector according to claim 5, wherein the protector is ceramic.

7. The protector according to claim 6, wherein the protector is made of a fired and glazed steatite ceramic.

8. The protector according to claim 1 further comprising a rollboard material lining an inner surface of the protector.

9. The protector according to claim 8, wherein the ceramic paper comprises ceramic paper roll board material.

10. An assembly that protects and thermally insulates a silicone sparkplug ignition wire and sparkplug connection, the assembly comprising:

a substantially silicone sparkplug boot that surrounds the sparkplug ignition wire and sparkplug connection, the boot having a constant outer diameter; and a protector having a cylindrical first portion with constant inner and outer diameters throughout a length of the first portion, wherein the first portion substantially surrounds the sparkplug boot and at least a portion of the sparkplug ignition wire connected to the sparkplug, the inner diameter of the first portion being larger than the outer diameter of the sparkplug boot such that an air gap is formed radially therebetween completely along an entire length of the sparkplug boot and axially at a location remote from the sparkplug to provide additional thermal insulation to the sparkplug boot and ignition wire.

11. The assembly according to claim 10, wherein a thickness of the air gap is constant.

12. The assembly according claim to 10, wherein a thickness of the air gap is not constant.

13. The assembly according to claim 10, further comprising:

a cylindrical second portion having constant inner and outer diameters through a length of the second portion, wherein the inner and outer diameters of the second portion are smaller than the inner and outer diameters of the first portion; and a transition portion connecting the first and second portions, the transition portion having a constant inner diameter and a continuously decreasing outer diameter in a direction from the first portion to the second portion.

14. The assembly according to claim 13, wherein the first, second and transition portions are integrally formed.

15. The assembly according to claim 14, wherein the protector is ceramic.

16. The assembly according to claim 15, wherein the protector is fired and glazed steatite ceramic.

17. The assembly according to claim 10 further comprising a rollboard material lining an inner surface of the protector.

18. The assembly according to claim 10, wherein the ceramic paper comprises ceramic paper roll board material.

* * * * *